US009986854B2

(12) United States Patent
Riley et al.

(10) Patent No.: US 9,986,854 B2
(45) Date of Patent: Jun. 5, 2018

(54) PRODUCT DISPLAY ASSEMBLY

(71) Applicant: Display Technologies, LLC, Lake Success, NY (US)

(72) Inventors: Daniel C. Riley, Hackensack, NJ (US); Anthony Camello, Staten Island, NY (US)

( * ) Notice: Subject to any disclaimer, the term of this patent is extended or adjusted under 35 U.S.C. 154(b) by 0 days. days.

(21) Appl. No.: 15/230,642

(22) Filed: Aug. 8, 2016

(65) Prior Publication Data

US 2017/0035218 A1 Feb. 9, 2017

Related U.S. Application Data

(60) Provisional application No. 62/201,797, filed on Aug. 6, 2015.

(51) Int. Cl.
*A47F 5/00* (2006.01)
*A47F 1/12* (2006.01)

(52) U.S. Cl.
CPC ..... *A47F 5/005* (2013.01); *A47F 5/0025* (2013.01); *A47F 1/125* (2013.01)

(58) Field of Classification Search
CPC .... A47F 1/12; A47F 5/005; A47F 1/04; A47F 5/0025; A47F 3/14; A47F 5/0068; A47F 5/0093
USPC ..... 211/59.3, 59.4, 184
See application file for complete search history.

(56) References Cited

U.S. PATENT DOCUMENTS 3,501,019 A * 3/1970 Armstrong ..... A47B 57/58 108/61
3,559,815 A * 2/1971 Huddleston ..... A47F 5/005 211/184
3,868,021 A * 2/1975 Heinrich ..... A47B 57/585 211/184
4,023,682 A * 5/1977 Niece ..... A47B 57/581 108/27
4,395,955 A * 8/1983 Pfeifer ..... A47F 5/005 108/61
4,478,337 A 10/1984 Flum
4,685,574 A 8/1987 Young et al.
4,763,963 A 8/1988 Lauffer et al.
4,958,739 A 9/1990 Spamer
4,997,094 A 3/1991 Spamer et al.
5,024,336 A 6/1991 Spamer
5,082,125 A * 1/1992 Ninni ..... A47F 5/0823 108/61
5,199,584 A 4/1993 Fowler et al.
(Continued)

OTHER PUBLICATIONS

International Search Report PCT/US2016/045964 dated Oct. 24, 2016.

*Primary Examiner* — Hiwot E Tefera
(74) *Attorney, Agent, or Firm* — Carter DeLuca Farrell & Schmidt, LLP

(57) ABSTRACT

A product display assembly includes a floor and a divider. The floor is configured to support a product. The divider is configured to selectively engage the floor such that the divider extends in a longitudinal direction. The divider includes a body portion and a proximal leg. The proximal leg is movable with respect to the body portion in a longitudinal direction between a first position where the proximal leg engages the floor and a second position where the proximal leg is free from engagement with the floor.

10 Claims, 15 Drawing Sheets

(56) References Cited

U.S. PATENT DOCUMENTS

| | | | | |
|---|---|---|---|---|
| 5,341,945 | A * | 8/1994 | Gibson | A47F 5/005 108/60 |
| 5,458,248 | A | 10/1995 | Alain | |
| 5,634,564 | A | 6/1997 | Spamer et al. | |
| 5,803,276 | A * | 9/1998 | Vogler | A47F 5/005 108/60 |
| 6,082,556 | A | 7/2000 | Primiano et al. | |
| 6,325,221 | B2 | 12/2001 | Parham | |
| 6,523,702 | B1 | 2/2003 | Primiano et al. | |
| 6,615,995 | B2 | 9/2003 | Primiano et al. | |
| 6,695,152 | B1 | 2/2004 | Fabrizio et al. | |
| 6,715,621 | B2 | 4/2004 | Boron | |
| 6,779,670 | B2 | 8/2004 | Primiano et al. | |
| 6,874,646 | B2 | 4/2005 | Jay | |
| 6,886,699 | B2 | 5/2005 | Johnson et al. | |
| 7,395,938 | B2 * | 7/2008 | Merit | A47F 5/005 211/184 |
| 8,016,139 | B2 | 9/2011 | Hanners et al. | |
| 8,104,630 | B2 * | 1/2012 | Schneider | A47F 5/005 211/184 |
| 8,162,154 | B2 | 4/2012 | Trulaske, Sr. | |
| 8,579,123 | B2 * | 11/2013 | Mueller | A47F 1/126 211/59.3 |
| 8,739,984 | B2 * | 6/2014 | Hardy | A47F 1/126 211/119.003 |
| 8,851,303 | B2 | 10/2014 | Crawbuck et al. | |
| 8,863,963 | B2 | 10/2014 | Hardy | |
| 9,107,516 | B2 | 8/2015 | Pichel | |
| 2001/0002658 | A1 | 6/2001 | Parham | |
| 2003/0132178 | A1 * | 7/2003 | Jay | A47B 96/021 211/59.2 |
| 2004/0020879 | A1 | 2/2004 | Close | |
| 2004/0065631 | A1 | 4/2004 | Nagel | |
| 2005/0044765 | A1 * | 3/2005 | Ahlund | G09F 3/204 40/649 |
| 2006/0260518 | A1 * | 11/2006 | Josefsson | A47F 5/005 108/61 |
| 2011/0094980 | A1 | 4/2011 | Cousin et al. | |
| 2011/0297630 | A1 | 12/2011 | O'Day et al. | |
| 2013/0020270 | A1 * | 1/2013 | Valiulis | A47F 5/005 211/59.2 |

* cited by examiner

PRODUCT DISPLAY ASSEMBLY

CROSS-REFERENCE TO RELATED APPLICATION

The present application claims priority to, and the benefit of, U.S. Provisional Patent Application Ser. No. 62/201,797 filed on Aug. 6, 2015, the entire contents of which being herein incorporated by reference in its entirety.

BACKGROUND

The present disclosure relates to product display assemblies, and more particularly, to various product display assemblies with a great amount of versatility and functionality.

Various types of product display assemblies and merchandisers are commonly used in retail environments to display different types of products. As opposed to simply positioning products on shelves, product display assemblies or units are commonly used to position products on a shelf in manner which automatically advances (e.g., via gravity or a pusher) a trailing or distal product (i.e., a product that is behind a lead or proximal-most product) closer to a consumer once the lead product has been removed from the shelf. As can be appreciated, such product display assemblies facilitate the arrangement and upkeep of products, as the trailing products do not have to be manually moved toward the front of the shelf, for instance.

Additionally, in retail environments, for example, floor space, shelf space, and space in cold vaults is limited, and retailers typically attempt to maximize the amount of products they can store/display in their retail space. Further, retailers and other users of product display assemblies often use products display units of different sizes to fit on a variety of types and sizes of shelves and cabinets, for example. Such users of product display assemblies must typically stock a variety of sizes of display assemblies or units to ensure they have enough product display assemblies or units to accommodate displaying a variety of goods.

Accordingly, it is often desirable for retailers to display products in as many viewable and reachable places as possible, while still allowing the products to automatically advance toward the proximal portion of the shelf. It is also desirable for retailers to be able to use product display assemblies to display a variety of sizes of products without the need to stock different sizes of product display assemblies.

SUMMARY

The present disclosure relates to a product display assembly. The product display assembly includes a floor and a divider. The floor is configured to support a product. The divider is configured to selectively engage the floor such that the divider extends in a longitudinal direction. The divider includes a body portion and a proximal leg. The proximal leg is movable with respect to the body portion in a longitudinal direction between a first position where the proximal leg engages the floor and a second position where the proximal leg is free from engagement with the floor.

In disclosed embodiments, the floor may include a distally-facing lip. The proximal leg may include a flange configured to engage the distally-facing lip of the floor. The proximal lip may be biased proximally with respect to the body portion of the divider.

It is also disclosed that the divider may define a recess between the proximal leg and the body portion.

In additional embodiments, a distal end of the divider may include an extension configured to selectively engage a distal portion of the floor.

In embodiments, the product display assembly may include a shelf. The floor may be configured to selectively engage the shelf.

The present disclosure also relates to a product display assembly including a floor, and a mounting clip. The floor includes a product-supporting surface and a plurality of longitudinal ribs. The mounting clip is configured to selectively secure the floor to a shelf, and includes a longitudinal base, a proximal leg extending proximally from the longitudinal base, a foot extending from the proximal leg, a first engagement structure disposed adjacent a distal portion of the longitudinal base, and a second engagement structure disposed in mechanical cooperation with the proximal leg. The first engagement structure is configured to simultaneously engage the floor and the shelf. The second engagement structure is configured to simultaneously engage the floor and the shelf. The foot is configured to engage adjacent longitudinal ribs.

In disclosed embodiments, an entirety of the mounting clip may be disposed beneath the product-supporting surface of the floor when the first engagement structure is simultaneously engaging the floor and the shelf, and when the second engagement structure is simultaneously engaging the floor and the shelf.

It is further disclosed that the foot may be oriented in a direction that is perpendicular to the longitudinal base.

The present disclosure also relates to a product display assembly including a first floor, a distal wall, and a divider. The first floor includes a width and a length. The width of the first floor is configured to be shortened, and the length of the first floor is configured to be shortened. The distal wall is selectively engageable with a portion of the first floor. A width of the distal wall is configured to be shortened. The divider is selectively positionable at a desired lateral position on the first floor, and is configured to mechanically engage the distal wall. A length of the divider is configured to be shortened.

In embodiments, the first floor may include a plurality of first grooves and a plurality of lateral supports. Each lateral support of the plurality of lateral supports may include a plurality of second grooves, and each of the first grooves and each of the second grooves may be configured to facilitate shortening the width of the floor.

It is further disclosed that the first floor may include a plurality of longitudinal ribs extending perpendicularly to the plurality of lateral supports. Each longitudinal rib of the plurality of longitudinal ribs may include a plurality of third grooves. Each third groove may be configured to facilitate shortening the length of the floor.

It is also disclosed that the product display assembly may also include a second floor and a floor connector. The floor connector may be configured to mechanically engage each of the first floor and the second floor. In embodiments, a width of the floor connector may be configured to be shortened. Additionally, the floor connector may include a plurality of grooves configured to facilitate shortening the width of the floor connector.

BRIEF DESCRIPTION OF THE DRAWINGS

Embodiments of the present disclosure are described hereinbelow with reference to the drawings wherein.

DETAILED DESCRIPTION

Figure 1A:
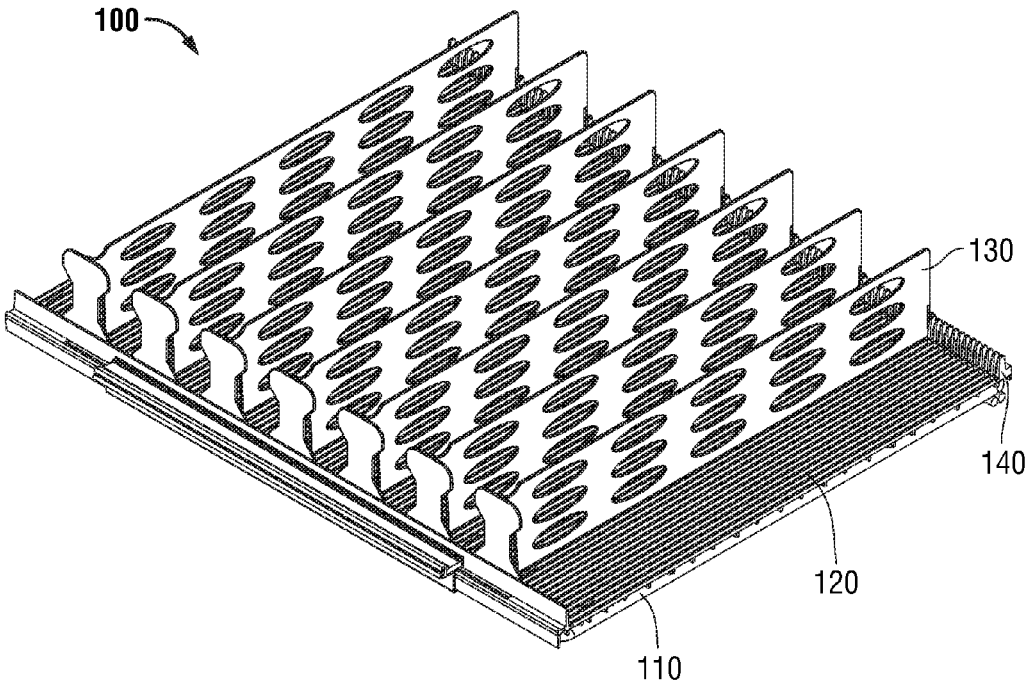
FIG. 1A is a perspective view of a product display assembly in accordance with an embodiment of the present disclosure.
Figure 1B:
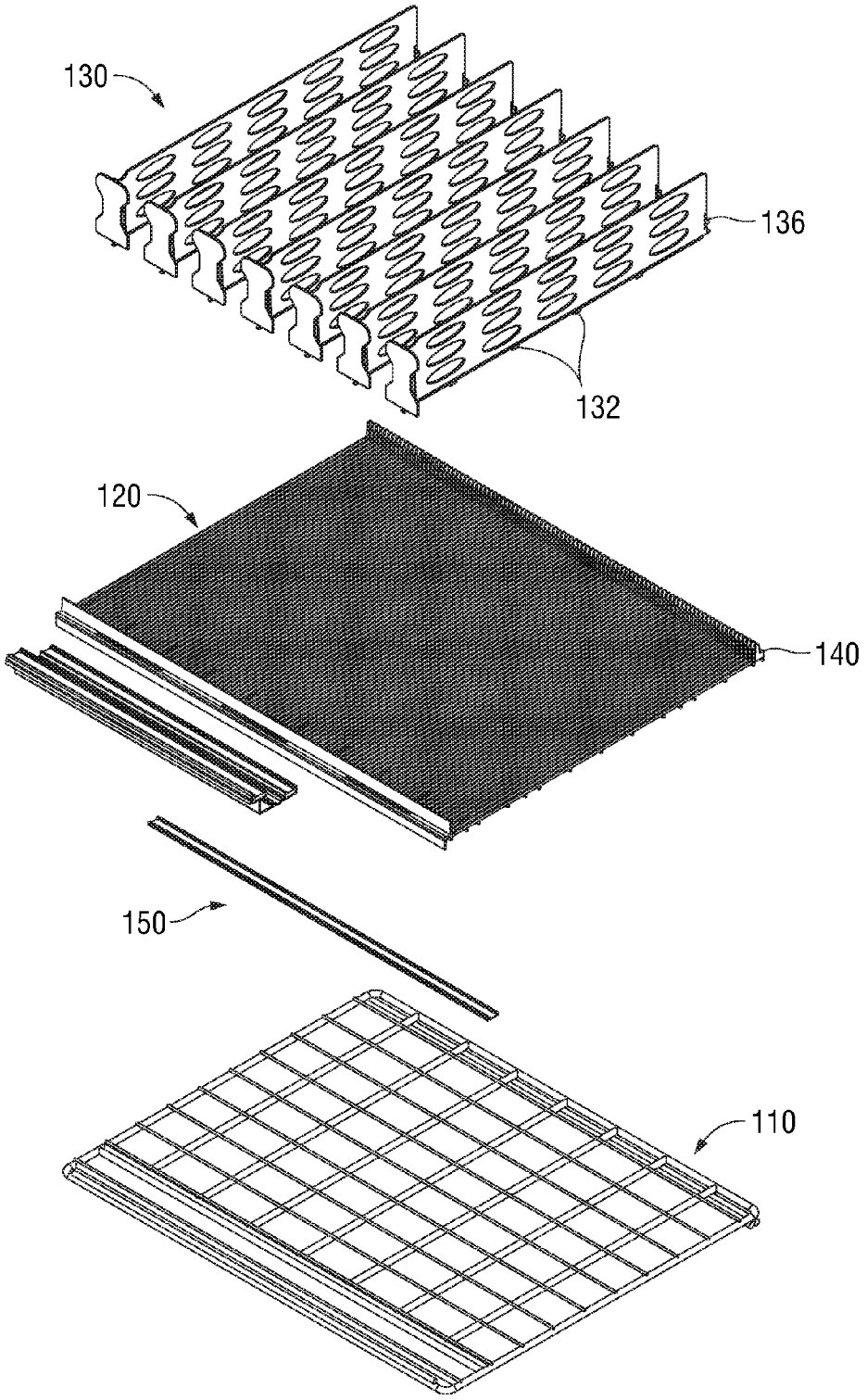
FIG. 1B is an assembly view of the product display assembly of FIG. 1A.

Embodiments of the presently disclosed product display assemblies are now described in detail with reference to the drawings, in which like reference numerals designate identical or corresponding elements in each of the several views. As used herein the term "distal" refers to that portion of the product display assembly or unit, or component thereof, farther from a user (e.g., customer), while the term "proximal" refers to that portion of the product display assembly or unit, or component thereof, closer to the user.

A first embodiment of a product display assembly is illustrated in FIGS. 1A-5 and is generally referenced by numeral 100. Product display assembly 100 includes a shelf 110, a floor 120, and a plurality of dividers 130, and is configured for engagement with a refrigerated case, for instance.

Figure 2:
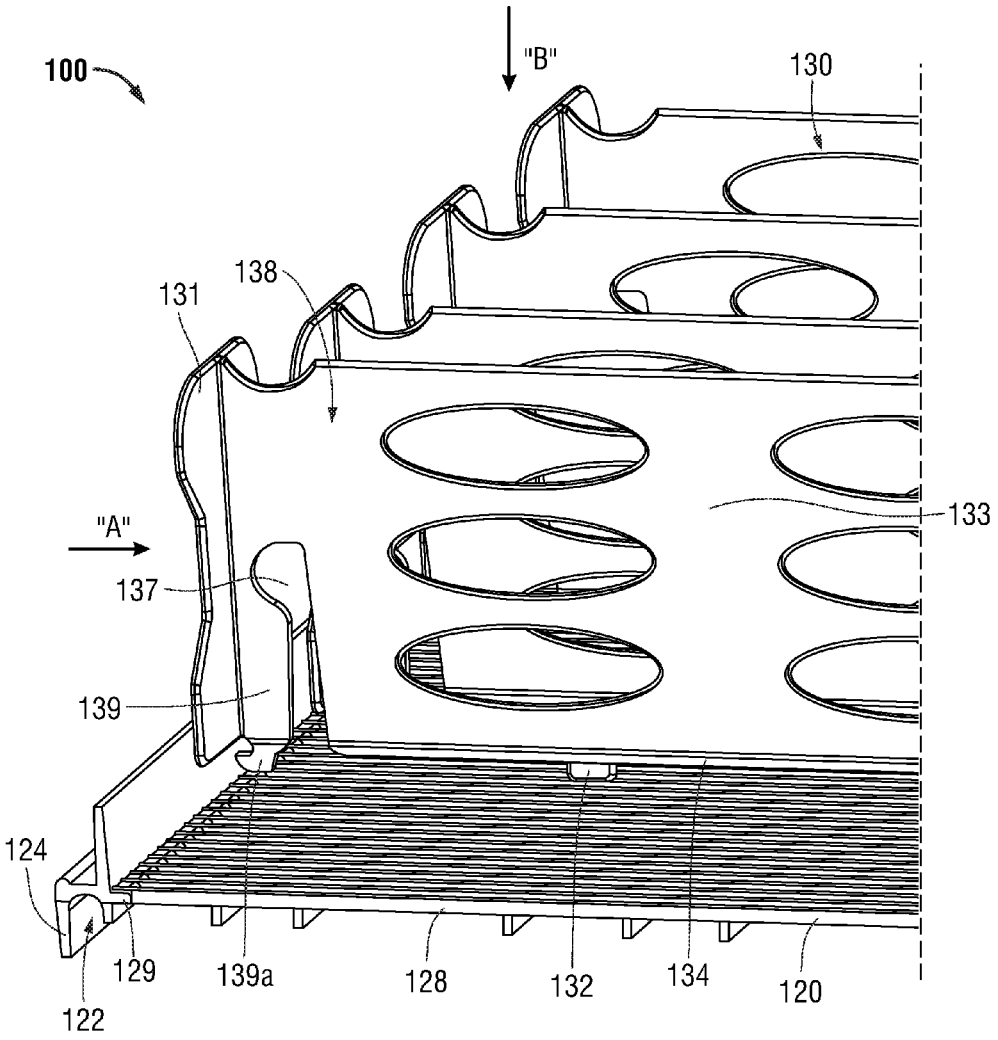
FIG. 2 is a perspective view of a proximal portion of dividers prior to being fully engaged with a floor of the product display assembly of FIG. 1A.
Figure 3:
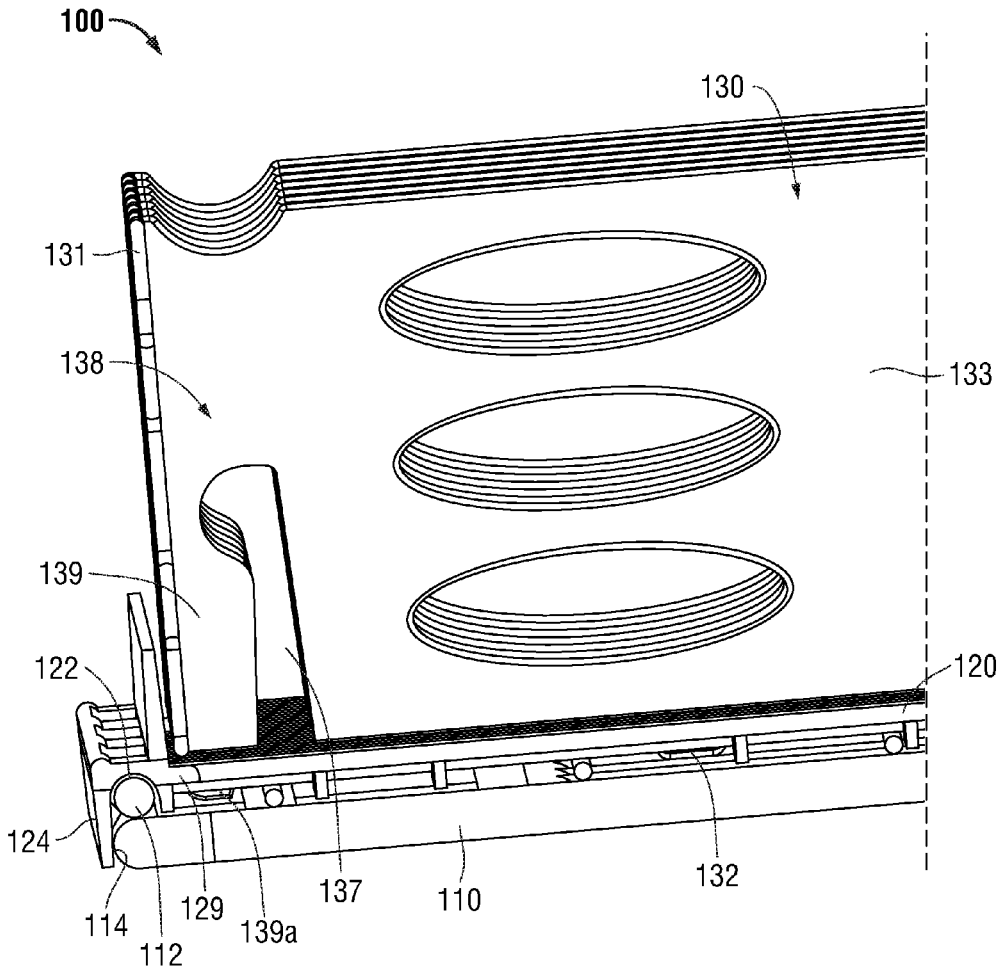
FIG. 3 is a perspective view of the dividers engaged with the floor of FIG. 2 of the product display assembly of FIG. 1A, and the floor engaged with a shelf.

With particular reference to FIGS. 2-5, floor 120 of product display assembly 100 may be molded to a particular size to mechanically engage shelf 110. More particularly, floor 120 includes a proximal cavity 122 and a proximal lip 124 (FIGS. 2 and 3). As shown in FIG. 3, proximal cavity 122 of floor 120 is configured to engage a proximal rib 112 of shelf 110 (e.g., in a frictional or snap-fit arrangement), and proximal lip 124 of floor 120 is configured for positioning proximally of a proximal edge 114 of shelf 110.

Figure 4:
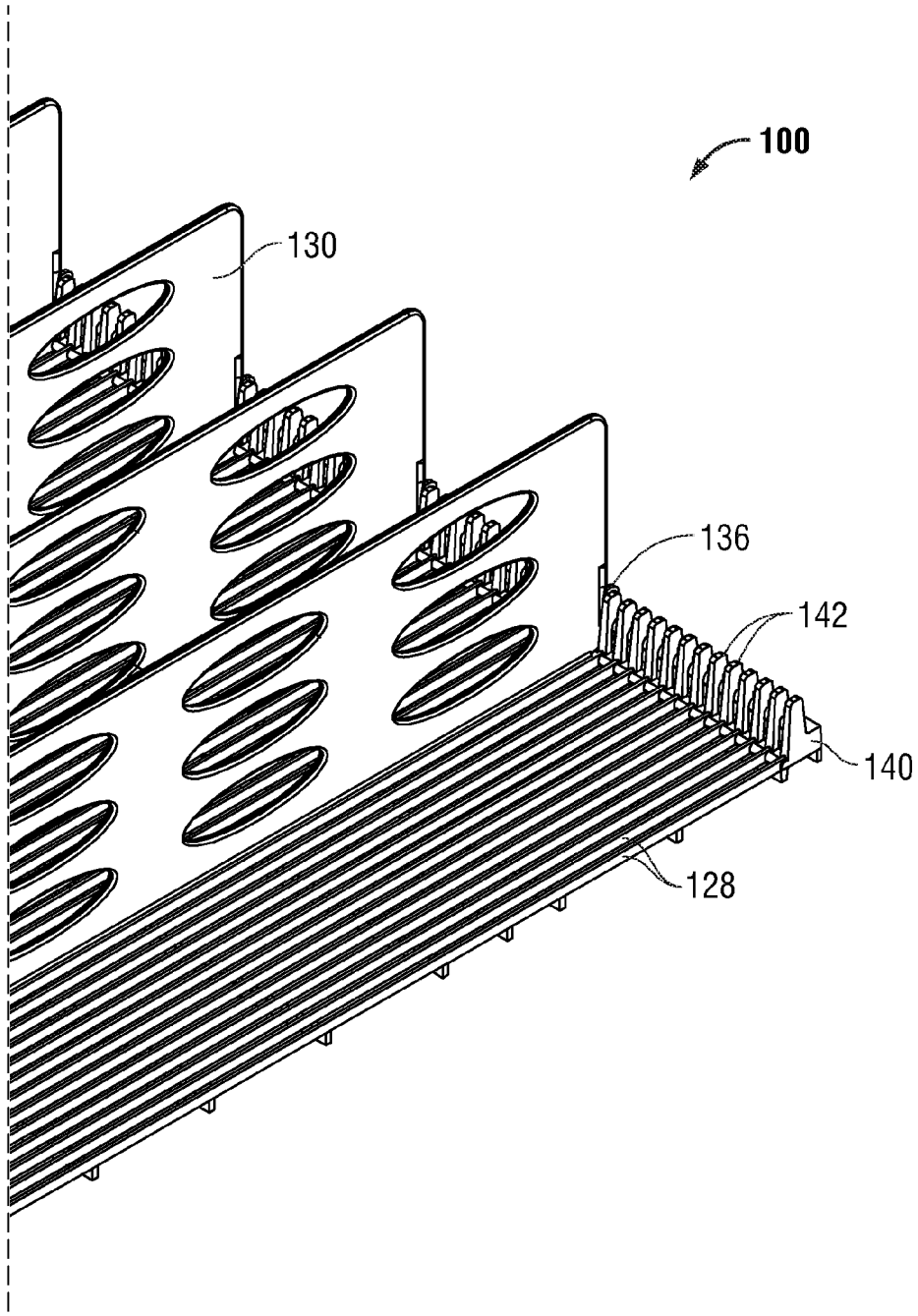
FIG. 4 is a perspective view of a distal portion of the dividers engaged with a distal wall of the floor of the product display assembly of FIG. 3.

Referring now to FIGS. 2-4, the engagement between plurality of dividers 130 and floor 120 is shown. Each divider 130 is positionable on the floor 120 at a particular location corresponding to the width of a product to be disposed between adjacent dividers 130. As such, a single product display assembly 100 can be used to display products of different widths.

More particularly, each divider 130 includes a plurality of tabs 132 downwardly depending from a lower surface 134 of the divider 130. Each tab 132 is configured to be positioned between adjacent rails 128 of the floor 120. To help stabilize a distal portion of the dividers 130, a distal portion or extension 136 each divider 130 is configured to mechanically, selective engage the floor 120. For example, the extension 136 is positioned between adjacent members 142 of a distal wall 140 of floor 120 (see FIG. 4).

With reference back to FIGS. 2 and 3, the mechanical engagement of the proximal portion of each divider 130 into a proximal portion of the floor 120 is shown. The divider 130 includes a recess 137 adjacent its proximal portion 138. Recess 137 separates a proximal leg 139 from a body portion 133 of the divider 130. Proximal leg 139 includes a flange 139*a* downwardly depending from a lower surface thereof. Flange 139*a* is configured to engage or sit below a proximal, distally-facing lip 129 of the floor 120, which thus hinders the divider 130 from moving upward and out of engagement with the floor 120. Additionally, the proximal leg 139 may be biased proximally with respect to the body portion 133 of the divider 130.

With particular reference to FIGS. 2 and 3, to engage the proximal portion of the divider 130 with the floor 120, a user urges the proximal leg 139 of the divider 130 distally (in the general direction of arrow "A" in FIG. 2), such that the flange 139*a* (e.g., an entirety of the flange 139*a*) is positioned distally of the distally-facing lip 129 of the floor 120. Subsequently, the proximal portion 138 of the divider 130 is urged downward toward the floor 120 (in the general direction of arrow "B" in FIG. 2) such that the flange 139*a* is positioned at least partially beneath the rails 128 of the floor 120. Next, the distally-directed force against the proximal leg 139 is released, and the proximal leg 139 moves proximally (in response to its proximal bias) such that at least a portion of the flange 139*a* is positioned proximally of a distal edge of the distally-facing lip 129 of the floor 120.

Each divider 130 also includes a proximal stop 131 that is configured to help maintain products on the floor 120. More specifically, the proximal stop 131 helps prevent a proximal-most product from falling proximally off of the floor 120. Additionally, the proximal stop 131 opposes the gravitational force and/or the force supplied by a pusher assembly (discussed below). Further, while the illustrated embodiments include a certain type of proximal stop 131, the present disclosure includes the use of any suitable type, shape, orientation, and number of proximal stops 131 per divider 130. Additionally, proximal stop 131 may be included on the floor 120 in lieu of or in addition to being included on the divider 130.

Figure 5:
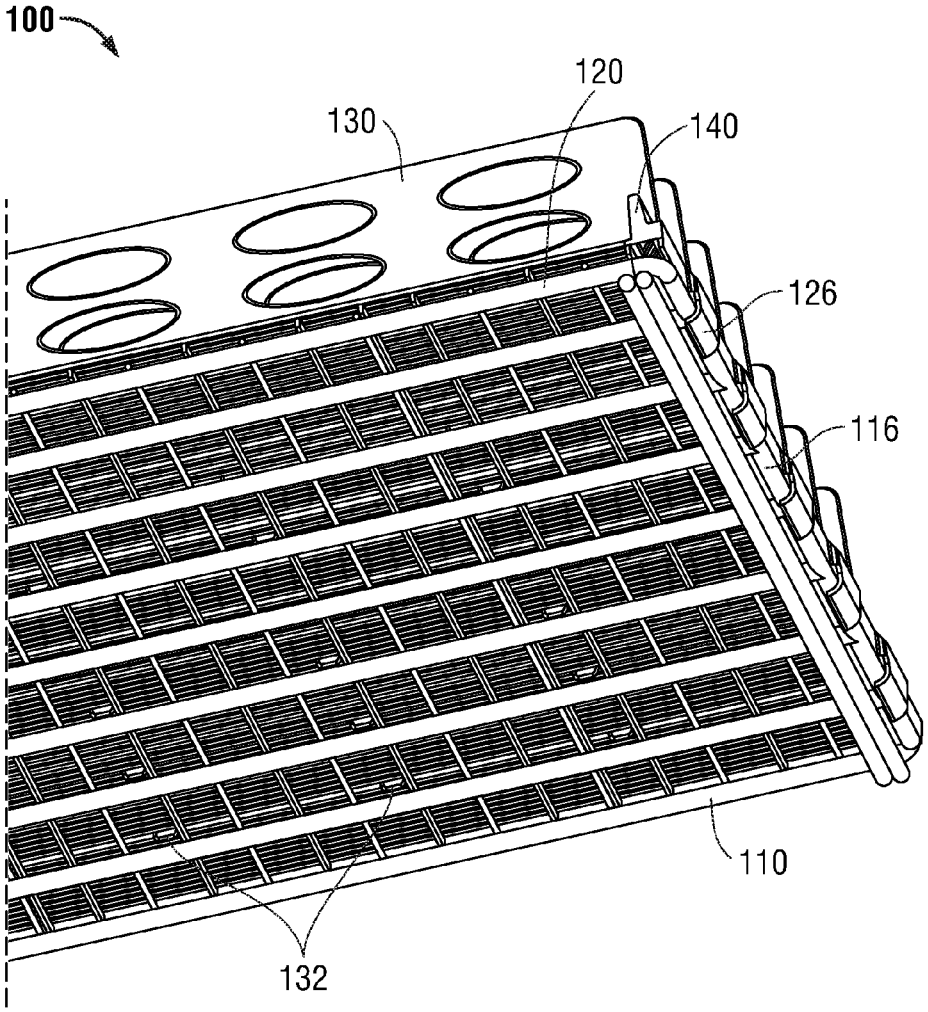
FIG. 5 is a perspective, underside view of the distal portion of the floor of the product display assembly of FIG. 4, engaged with a shelf.
Figure 6A:
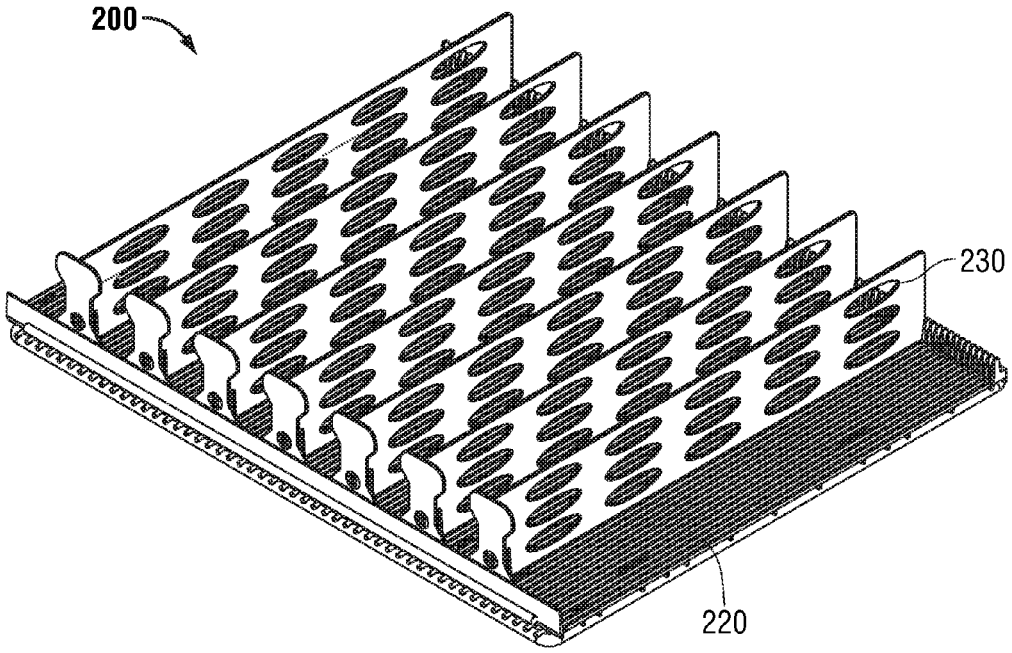
FIG. 6A is a perspective view of a product display assembly in accordance with another embodiment of the present disclosure.
Figure 6B:
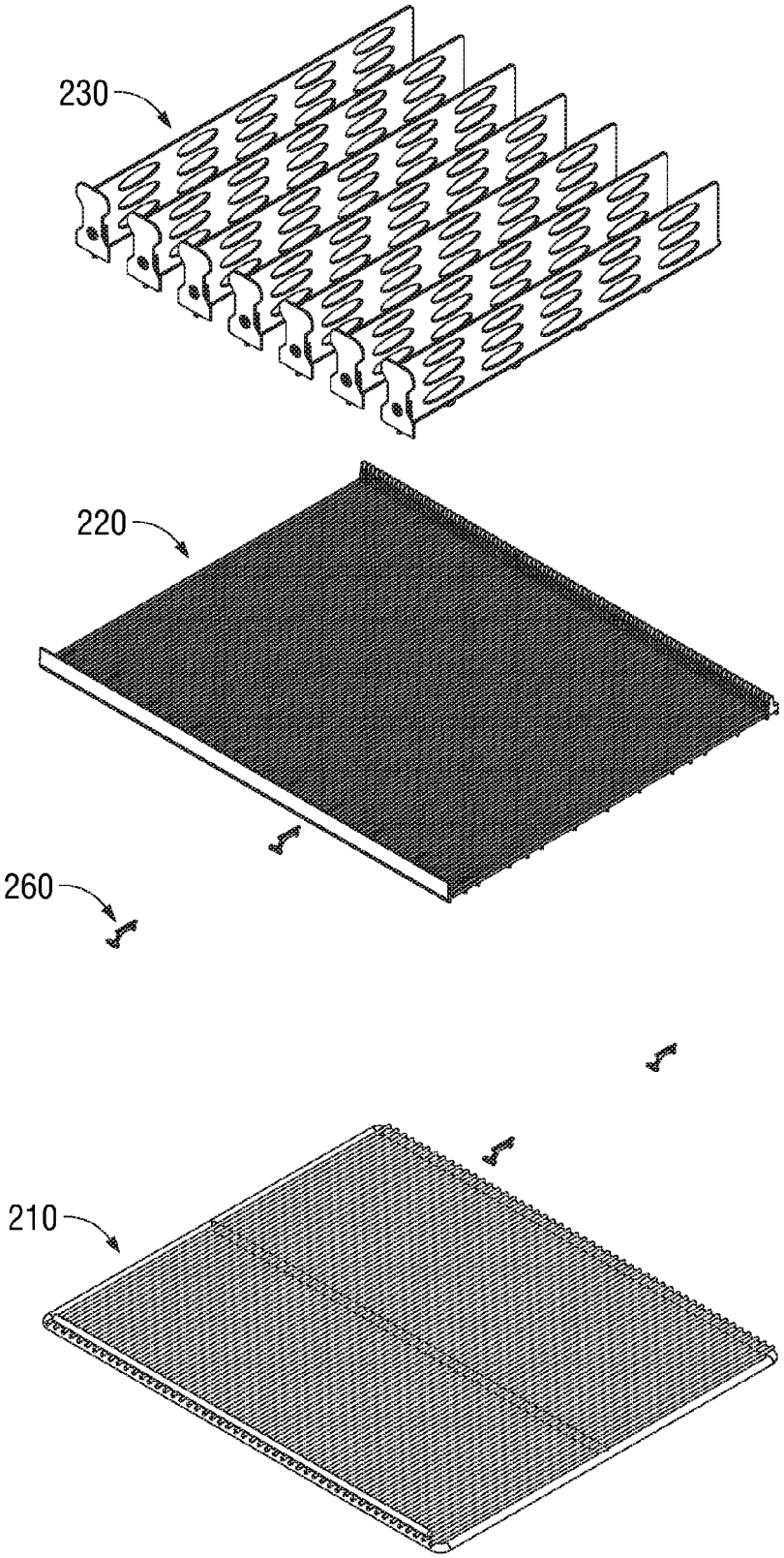
FIG. 6B is an assembly view of the product display assembly of FIG. 6A.

Referring now to FIG. 5, a plurality of distal hooks 126 is disposed at a distal end of the floor 120. As shown, each distal hook 126 is configured to engage a distal rib 116 of shelf (e.g., in a frictional or snap-fit arrangement). As can be appreciated, the sizes (e.g., proximal-to-distal; and side-to-side) of the floor 120 and/or the shelf 110 are selected to enable or facilitate the mechanical connection therebetween.

Referring back to FIG. 1B, the product display assembly 100 may also include at least one light 150 (e.g., a strip of lights) for positioning and/or mechanical engagement with any portion of the product display assembly 100 (e.g., the proximal lip 124 of the floor 120, a lower portion of the floor 120, etc.).

Referring now to FIGS. 6A-9, a second embodiment of a product display assembly is shown and is generally indicated by reference character 200. Product display assembly 200 includes a floor 220, a plurality of dividers 230 and a plurality of mounting clips 260, and is configured for engagement with a shelf 210 (e.g., a wire shelf) used in a refrigerated case, for example. Since shelves typically used in refrigerated cases are not uniform (e.g., different sizes, spacing between adjacent ribs, precise location of proximal and distal ribs, etc.), the floor 220 of this embodiment cannot be sized such that it can securely engage every type of shelf 210. Accordingly, a plurality of mounting clips 260 is used to facilitate the mechanical engagement between the floor 220 and the shelf 210.

Figure 7:
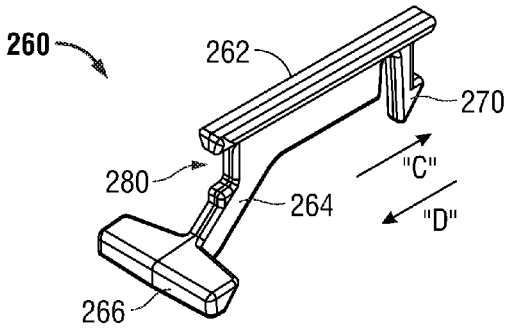
FIG. 7 is a perspective view of a mounting clip of the product display assembly of FIGS. 6A-6B.
Figure 8:
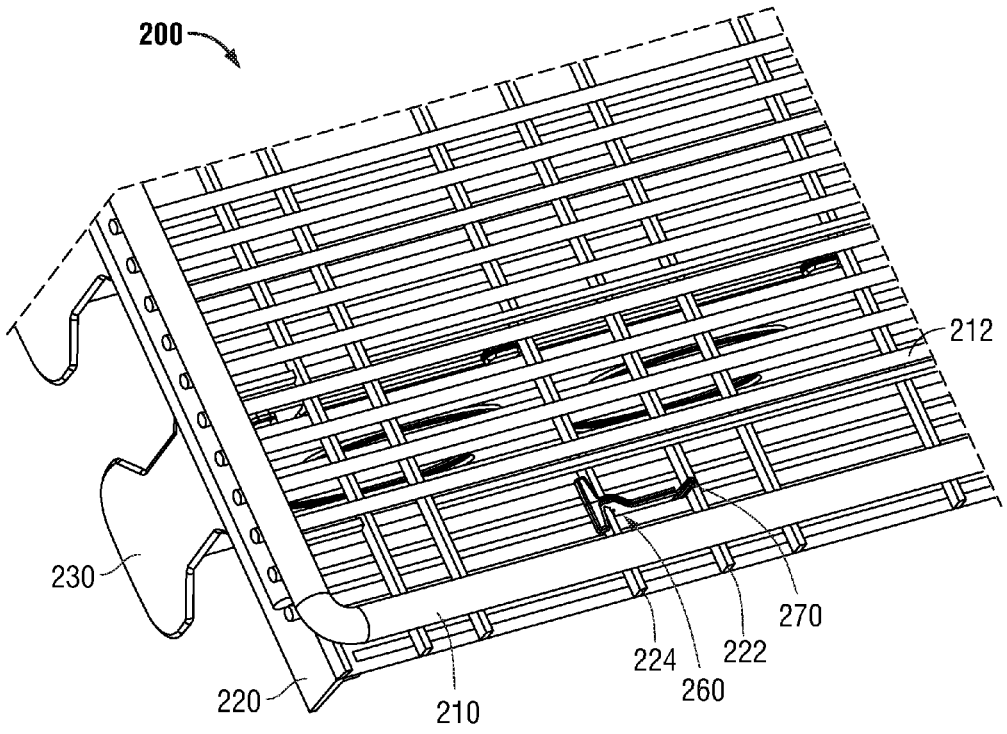
FIGS. 8 and 9 are perspective underside and top views, respectively, of the mounting clip of FIG. 7 engaging a floor of the product display assembly of FIG. 6A, and the floor engaged with a shelf.
Figure 9:
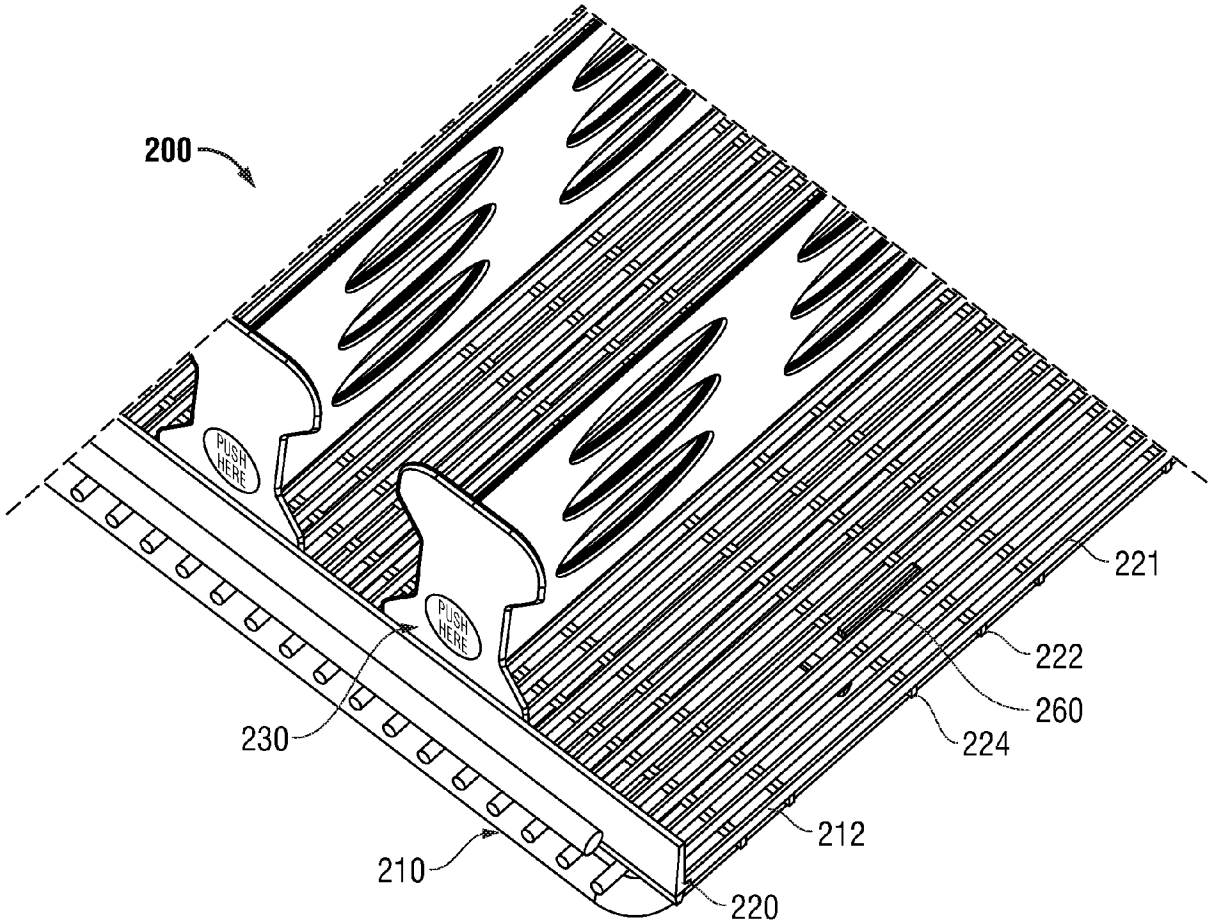

The floor 220 of product display assembly 200 may be molded to a particular size to mechanically engage shelf 210 (e.g., an existing shelf) using the plurality of mounting clips 260. With particular reference to FIGS. 7-9, each mounting clip 260 engages the floor 220 and the shelf 210, while no portion of the mounting clip 260 is positioned above a product-supporting surface 221 (FIG. 9) of the floor 220.

With continued reference to FIGS. 7-9, each mounting clip 260 includes a longitudinal base 262, a proximal leg 264, a foot 266 extending laterally from the proximal leg 264, a first engagement structure 270, and a second engagement structure 280 (see FIG. 7). The first engagement structure 270 is cantilevered from a portion of the longitudinal base 262 and is longitudinally pivotable with respect to the longitudinal base 262 in a first (e.g., distal) direction indicated by arrow "C" in FIG. 7 and in a second (e.g., proximal) direction indicated by arrow "D" in FIG. 7, and thus between a first, distal position and a second, proximal position. It is envisioned that the first engagement structure 270 is biased away from the second engagement structure 280 (i.e., in the general direction of arrow "C", or distally in FIGS. 8 and 9).

In use, the longitudinal base 262 of mounting clip 260 is positioned parallel to longitudinal ribs 224 of the floor 220 and is capable of being mechanically engaged with the floor 220 and the shelf 210 from below the shelf 210. The first engagement structure 270 (which is shown in a distal position in FIGS. 8 and 9; mounting clip 260 may be also positioned such that first engagement structure 270 is in a proximal position) is positioned in contact with a first lateral rib 222 of the floor 220 (FIG. 8). The longitudinal base 262 of the mounting clip 260 is then urged distally (in the illustrated orientation) such that the first engagement structure 270 moves proximally toward the second engagement structure 280. In this position, the foot 266 is moved toward the floor 220 until it contacts an underside of two adjacent longitudinal ribs 212 of the shelf 210, and the second engagement structure 280 engages a second lateral rib 224 of the floor 220 (see FIGS. 8 and 9). Here, the first engagement structure 270 moves distally (e.g., in response to its bias) with respect to longitudinal base 262 into engagement with the first lateral rib 222 of the floor 220, thereby securing the floor 220 to the shelf 210.

To disengage the mounting clip 260, a user may move the foot 266 toward the first engagement structure 270 (i.e., distally in the illustrated orientation) to pivot the first engagement structure 270 toward the second engagement structure 280 (i.e., proximally in the illustrated orientation), followed by moving the foot 266 away from the shelf 210 thereby disengaging the first and second engagement structures 270 and 280 from the respective first and second lateral ribs 222 and 224 of the floor 220.

The plurality of dividers 230 operate, function, and appear similar to or the same as the plurality of dividers 130 as discussed with regard to product display assembly 100.

Referring now to FIGS. 10A-13, a third embodiment of a product display assembly is shown and is generally indicated by reference character 300. Product display assembly 300 includes at least one floor 320, a plurality of dividers 330, at least one distal wall 340 and a plurality of floor connectors 350, and is configured for engagement with a shelf (e.g., a wire shelf) used in a refrigerated case (e.g., a double-wide refrigerated case), for example. Since shelves typically used in refrigerated cases are not uniform (e.g., different widths, depths, spacing between adjacent ribs, precise location of proximal and distal ribs, etc.), the floor 320 of this embodiment cannot be sized such that it can securely engage every type of shelf. Accordingly, several components of product display assembly 300 include adjustable sizes. Further, it is envisioned that the floor 320 rests on the shelf, is mounted to the shelf using mounting clips 260, or is otherwise engaged with the shelf.

With reference to FIGS. 10B-13, floor 320 includes a first floor **320*a* and a second floor 320*b*, and are configured for engagement with each other. More or fewer floors (or floor sections) 320 are usable with the product display assembly 300. Floor connectors 350 are positionable in engagement with two adjacent floors 320 (e.g., the first floor 320*a* and the second floor 320*b*) to interconnect the floors 320. More particularly, with reference to FIGS. 12 and 13, each floor connector 350 includes an elongated base 352 (FIG. 12), a plurality of grooves 354 (FIG. 12) within the elongated base 352, and a plurality of legs 356 (FIG. 13) extending from the elongated base 352. The width of the floor connector 350 is adjustable by breaking the elongated base 352 at a desired groove 354 of the plurality of grooves 354. The floor connector 350 engages the floor 320 or adjacent floors 320*a*, 320*b* by inserting each leg 356 between adjacent longitudinal ribs 328 of the floor 320 (e.g., proximally- or distally-adjacent a lateral support 324 of the floor 320). It is disclosed that the legs 356 of the floor connection 350 frictionally engage adjacent longitudinal ribs 328 of the floor 320 (e.g., via a snap-fit connection). To remove floor connector 350 from engagement with the floor 320, a user may exert a downwardly-directed force on each of the legs 356 until the legs 356 are disengaged from adjacent longitudinal ribs 328 of the floor 320**.

Figure 10A:
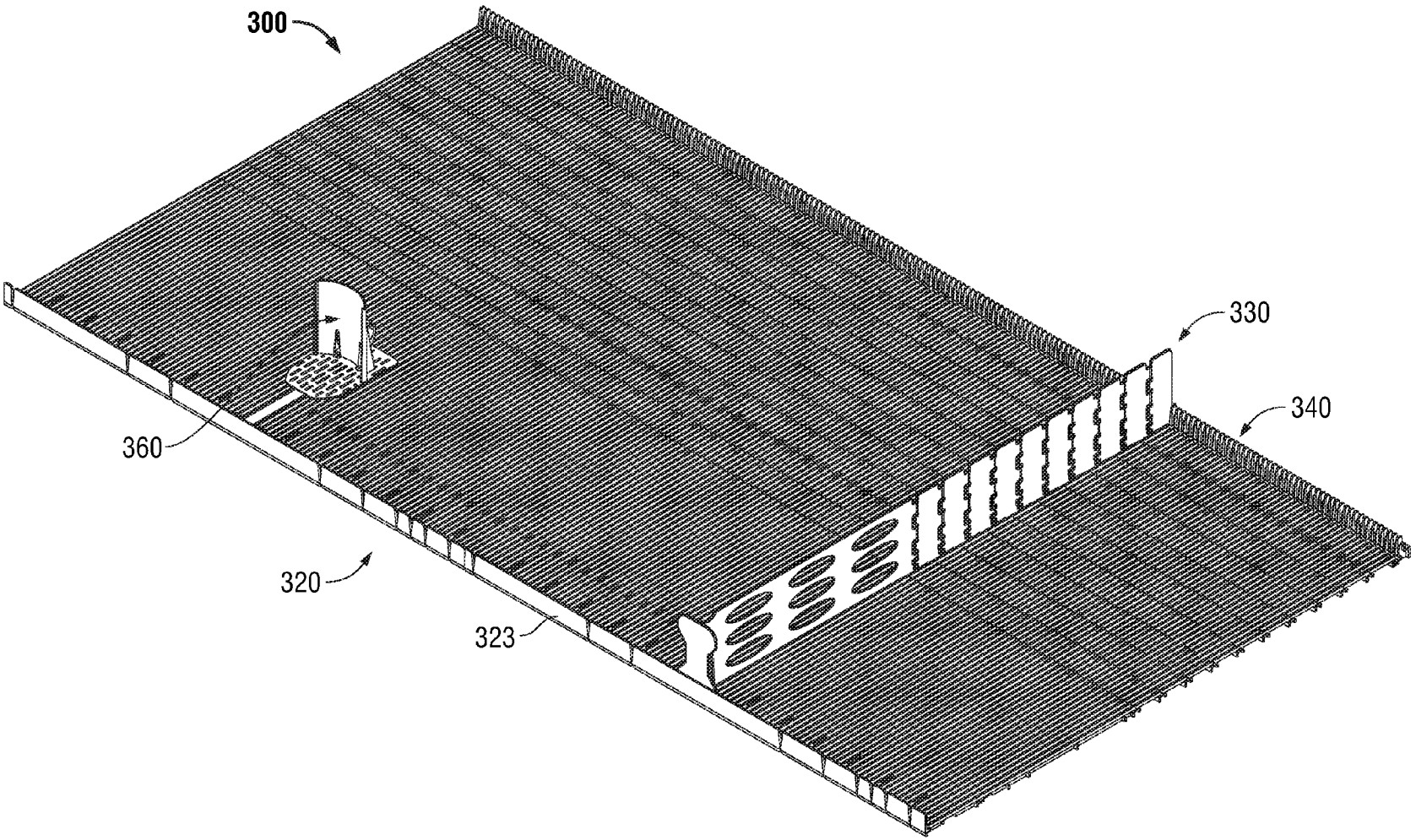
FIG. 10A is a perspective view a product display assembly in accordance with another embodiment of the present disclosure.
Figure 10B:
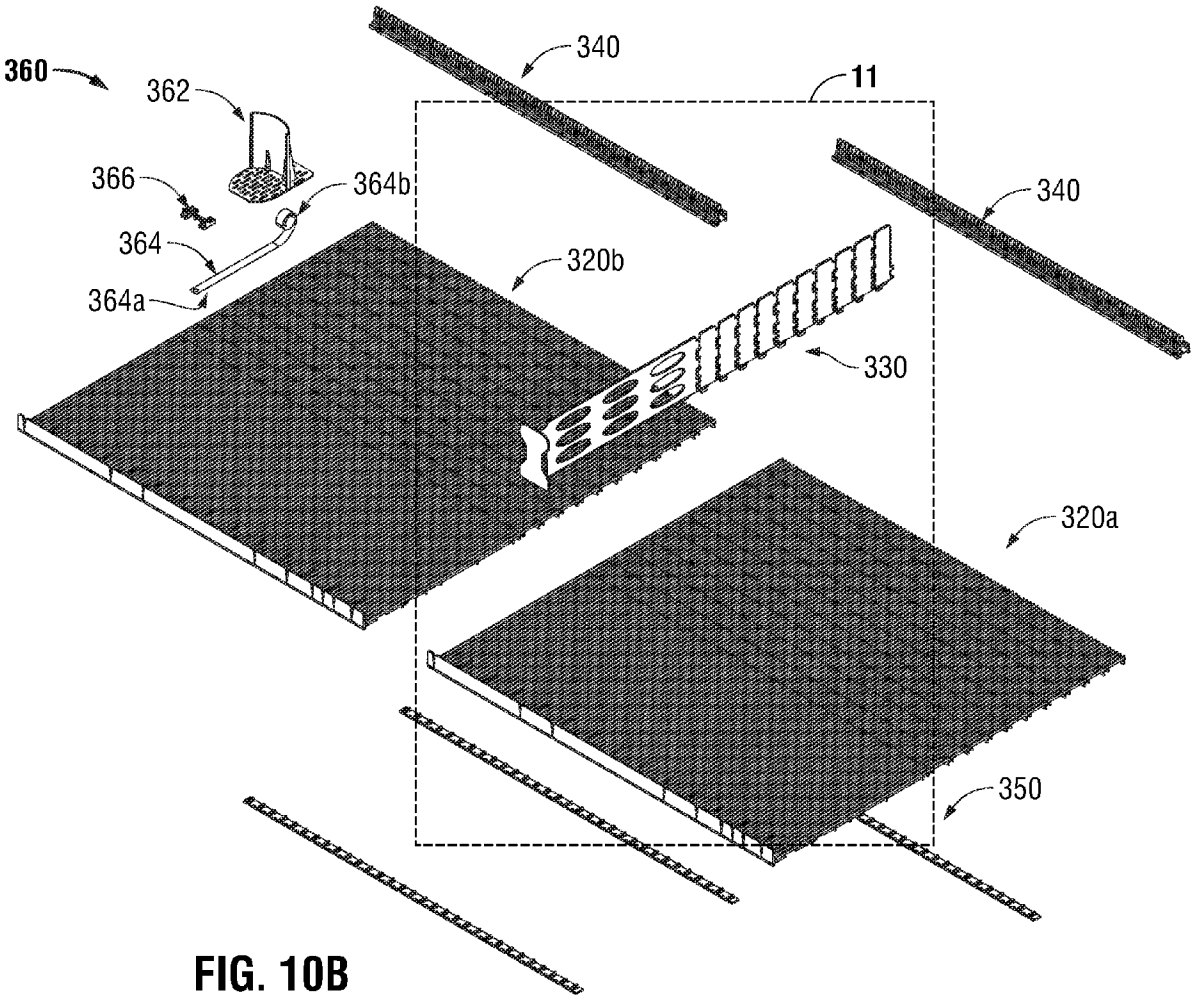
FIG. 10B is an assembly view of the product display assembly of FIG. 10A.

When the floor connector 350 is engaged with the floor 320, an upper-most portion 357 of each leg 356 is positioned below a product-supporting surface 322 of the floor 320 (see FIG. 13) such that the floor connector 350 does not interfere with the movement or positioning of products on the product-supporting surface 322. As shown in FIG. 10B, more than one floor connector 350 may be used to connect two adjacent floors **320*a*, 320*b***.

Figure 11:
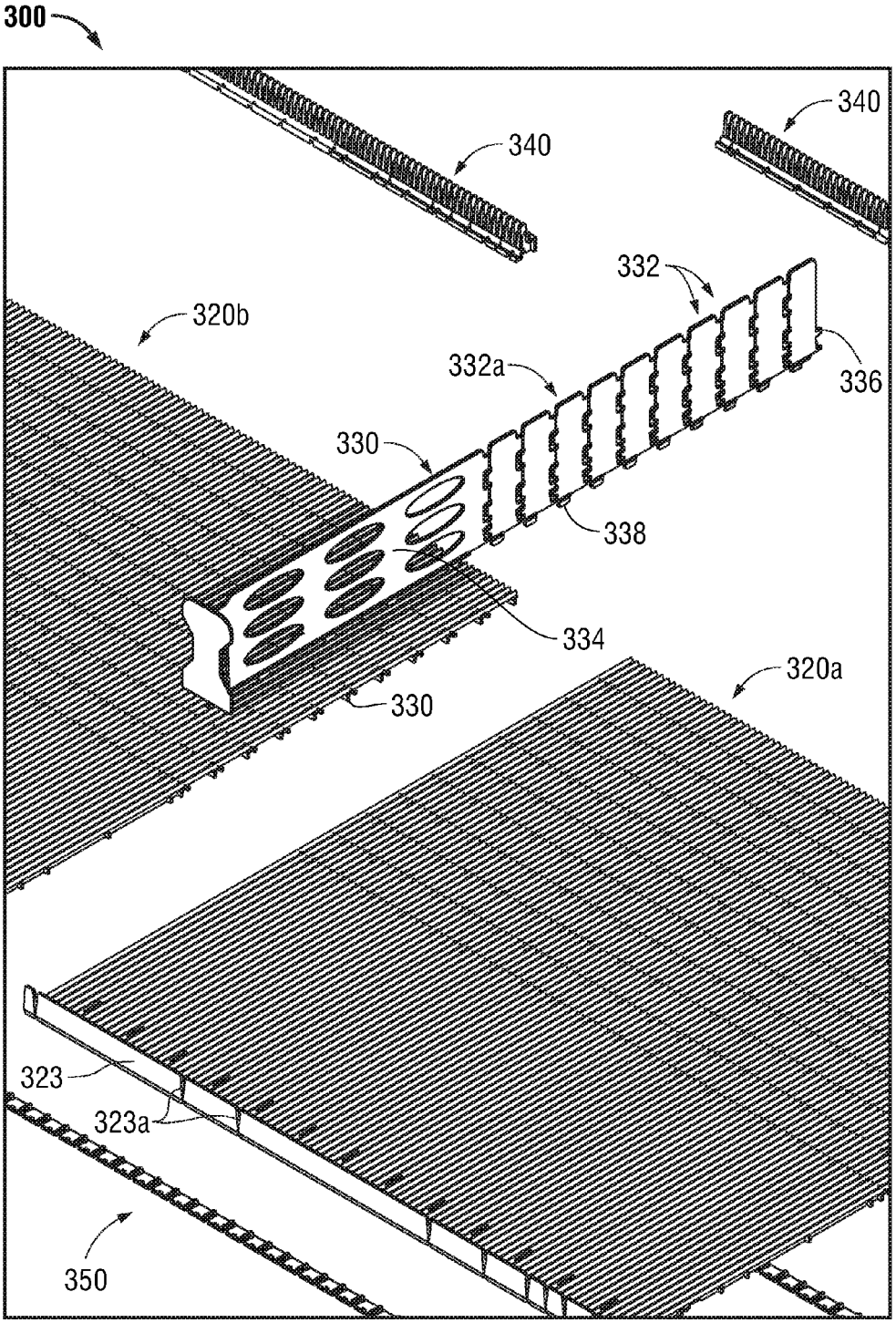
FIG. 11 is an enlarged view of the area of detail indicated in FIG. 10B.
Figure 12:
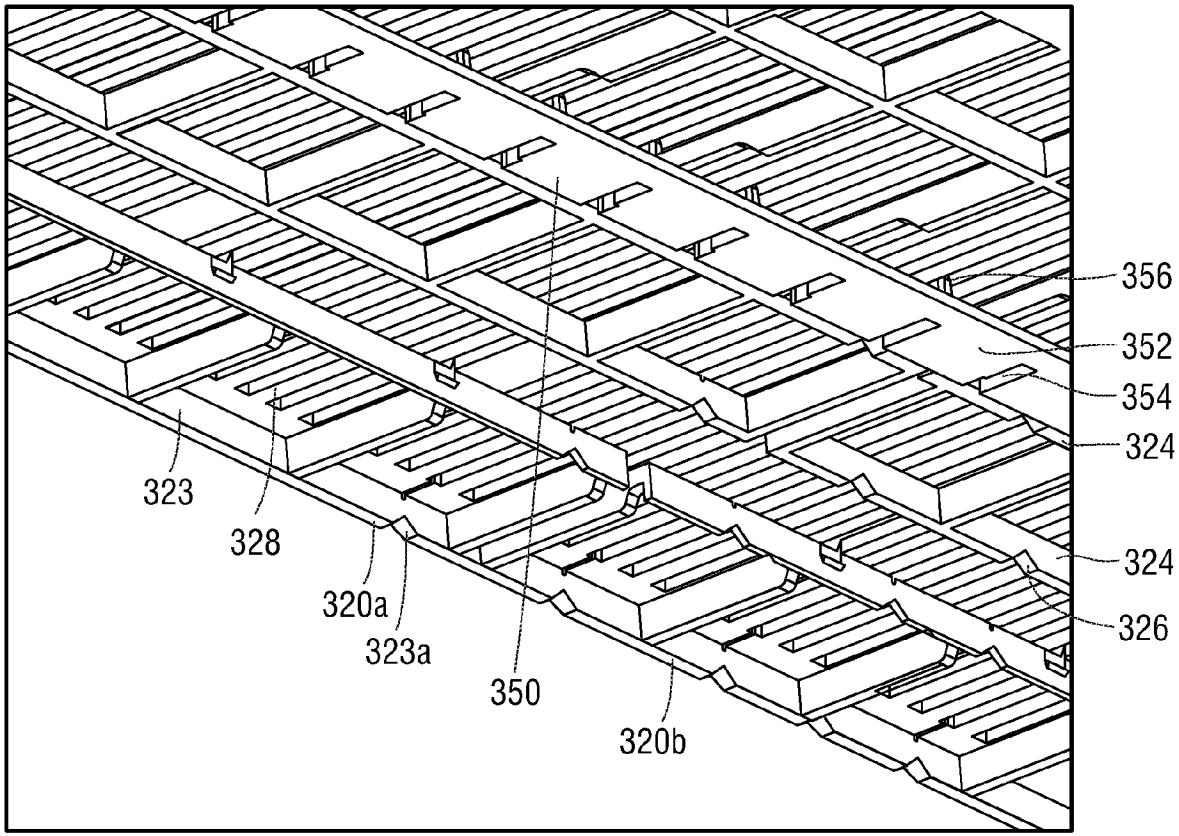
FIGS. 12 and 13 are perspective underside and top views, respectively, of two floors and a floor connector of the product display assembly of FIG. 10A.
Figure 13:
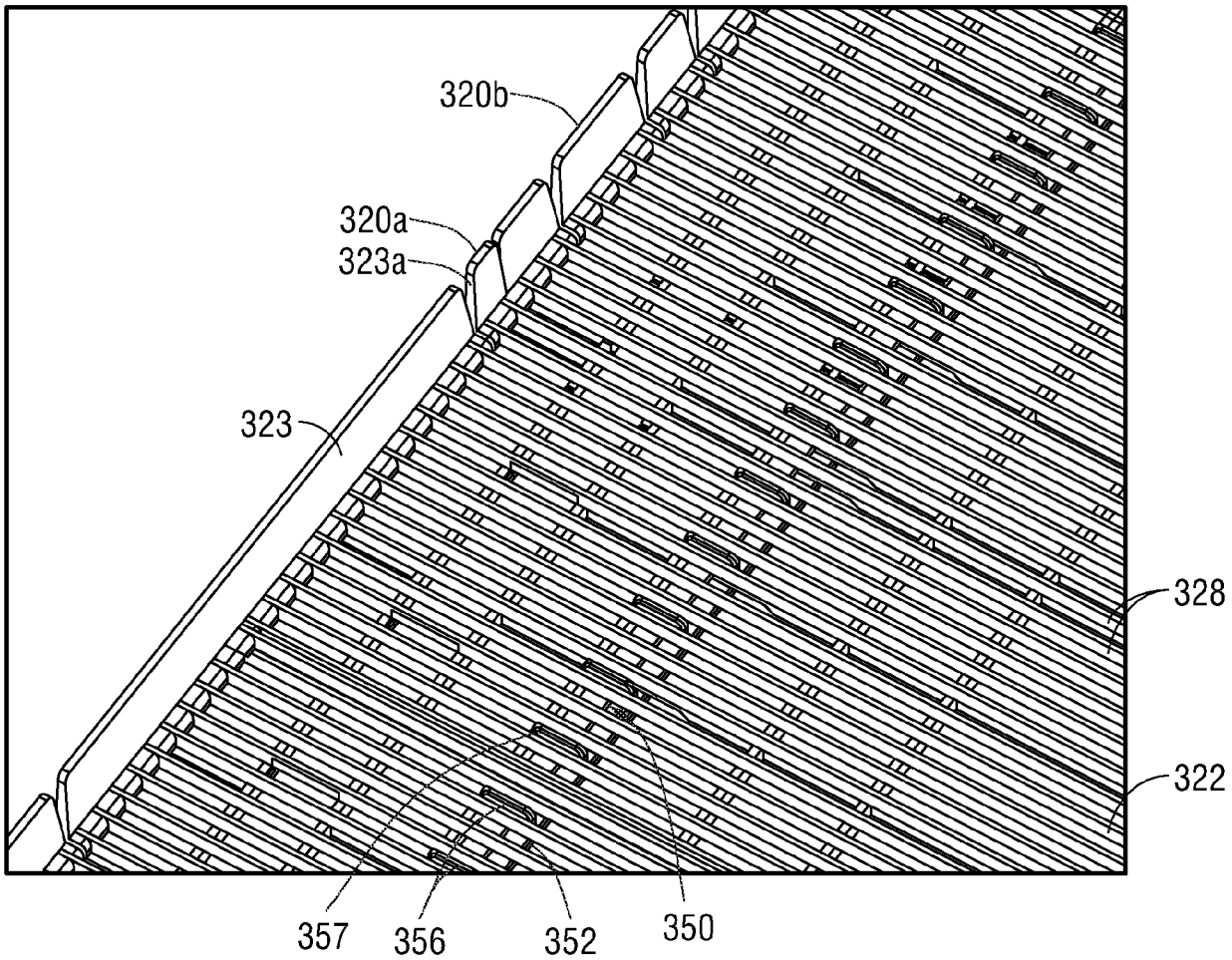

Each floor 320 is both depth adjustable and width adjustable, and includes a proximal wall 323 having first grooves **323*a* (FIGS. 12 and 13), a plurality of lateral supports 324 having second grooves 326 (FIG. 12), and a plurality of longitudinal ribs 328 having third grooves 330 (FIG. 11). While the term groove or grooves is used to describe these features, other features (e.g., perforations, etc.) may be used to help facilitate breaking off portions of the product display assembly 300. To decrease the width and the length of the floor 320, sections of the floor 320** can be broken apart from the remaining sections, as discussed below.

To decrease the width of the floor 320, the appropriate amount of the floor 320 is broken off along one first groove 323*a* of proximal wall 323 and along one laterally-aligned set of second grooves 326 of lateral supports 324; the laterally-aligned set of second grooves 326 is laterally aligned with the first groove 323*a* (i.e., a proximal-to-distal line intersects each of the laterally-aligned set of second grooves 326 and a corresponding first groove 323*a*). The floor 320 is usable when either or both lateral sides of the floor 320 are removed.

To decrease the length of the floor 320, the appropriate amount of the floor 320 is broken off along a longitudinally-aligned set of third grooves 330 of longitudinal ribs 328 (i.e., a side-to-side or right-to-left line intersects each of the longitudinally-aligned set of third grooves 330). The floor 320 is configured such that when the distal portion of the floor 320 is removed, the proximal portion of the floor 320 is usable.

The distal wall 340 is configured to engage a distal portion of the floor 320 via a snap-fit connection (or other suitable ways). For example, it is envisioned that the distal wall 340 includes a plurality of legs, each of which frictionally fit between and engage two adjacent longitudinal ribs 328. Distal wall 340 can also be made shorter to match or substantially match the width of the floor 320 by breaking off an appropriate amount. It is envisioned that the distal wall 340 includes grooves for guiding and facilitating the breaking or severing thereof.

The plurality of dividers 330 operate and function similar to or the same as the plurality of dividers 130 as discussed with regard to product display assembly 100. However, dividers 330 are also adjustable in length. In particular, each divider 330 includes a plurality of distal sections 332, with each distal section 332 being removable from an adjacent distal section 332; the proximal-most distal section 332*a* is removable from a body portion 334 of the divider 330. Additionally, each of the distal sections 332 and the body portion 334 includes at least one distal extension 336 for engaging the distal wall 340, and at least one leg 338 for engaging the floor 320 (FIG. 11).

As noted above, the width of the floor connector 350 is adjustable by breaking the elongated base 352 at a desired groove of the plurality of grooves 354. It is envisioned that the grooves 354 of the floor connector 350, each of the first grooves 323*a* of the proximal wall 323, and each set of laterally-aligned second grooves 326 (and grooves of the distal wall 340, if included) are laterally aligned. It is also envisioned that the location and spacing of these grooves 323*a*, 326 are positioned based on popular sizes of shelves and/or refrigerated coolers, for example. It is further envisioned that each set of longitudinally-aligned third grooves 330 is longitudinally aligned with intersections between adjacent distal sections 332 of each divider 330.

A pusher assembly 360 is also shown in FIG. 10B. Pusher assembly 360 is usable with any embodiment of the product display assembly 100, 200, 300 disclosed herein, and is configured to urge products on the respective floor 120, 220, 320 proximally (e.g., when the floor is positioned horizontally instead of a distal portion of the floor being elevated with respect to the proximal portion of the floor). Pusher assembly 360 includes a pusher 362, a biasing element 364, and a retainer 366. Retainer 366 is configured to frictionally engage the floor 320 (e.g., via a snap-fit arrangement), and is configured to retain a portion (e.g., a proximal portion 364*a*) of biasing element 364 with respect to the floor. A distal portion 364*b* of the biasing element 364 is positioned in contact with the pusher 362 to urge the pusher 362 proximally with respect to the floor 320. As can be appreciated, one or more than one pusher assembly 360 may be associated (e.g., selectively usable) with any or all of the rows of products (i.e., one pusher assembly 360 between adjacent dividers 130, 230, 330).

Further details of related product display units are described in commonly-owned U.S. Pat. No. 5,645,176, which issued on Jul. 8, 1997, the entire contents of which being incorporated by reference herein.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A product display assembly, comprising:

a floor including a product-supporting surface configured to support a product thereon, the floor including a distally-facing lip;

a divider configured to selectively engage the floor such that the divider extends in a longitudinal direction, the divider including a body portion and a proximal leg, the proximal leg being movable with respect to the body portion in a longitudinal direction between a first position where the proximal leg engages the floor beneath the product-supporting surface thereof and a second position where the proximal leg is free from engagement with the floor, the proximal leg including a flange configured to engage the distally-facing lip of the floor, wherein a predetermined amount of movement of the flange of the proximal leg towards the body portion of the divider is configured to cause the flange to disengage the distally-facing lip of the floor; and a distal wall disposed in mechanical cooperation with the floor, the distal wall including a plurality of members extending within a different plane than a plane defined by the floor, wherein a distal most end of the divider is positionable between adjacent members of the distal wall.

2. The product display assembly according to claim 1, wherein the proximal leg is biased proximally with respect to the body portion of the divider.

3. The product display assembly according to claim 1, wherein the divider defines a recess between the proximal leg and the body portion.

4. The product display assembly according to claim 3, wherein the proximal leg is configured to move toward the recess when the proximal leg moves from the first position to the second position.

5. The product display assembly according to claim 4, wherein a size of the recess is configured to change when the proximal leg moves from the first position to the second position.

6. The product display assembly according to claim 1, wherein a distal end of the divider includes an extension configured to selectively engage a distal portion of the floor.

7. The product display assembly according to claim 6, wherein the extension of the distal end of the divider is fixed from movement relative to the body portion of the divider.

8. The product display assembly according to claim 1, further comprising a shelf, the floor configured to selectively engage the shelf.

9. The product display assembly according to claim 1, wherein at least a portion of the adjacent members of the distal wall are disposed substantially perpendicular to the plane defined by the floor.

10. The product display assembly according to claim 1, further comprising a mounting clip configured to selectively secure the floor to a shelf, the mounting clip including a longitudinal base, a proximal leg extending proximally from the longitudinal base, a foot extending from the proximal leg, a first engagement structure disposed adjacent a distal portion of the longitudinal base, and a second engagement structure disposed in mechanical cooperation with the proximal leg, wherein the first engagement structure is configured to simultaneously engage a first region of the floor and the shelf, wherein the second engagement structure is configured to simultaneously engage a second region of the floor and the shelf, and wherein the foot is configured to engage adjacent longitudinal ribs.

* * * * *